US005400753A

United States Patent [19]

Andress et al.

[11] Patent Number: 5,400,753

[45] Date of Patent: Mar. 28, 1995

[54] AIR FILTER FOR INTERNAL COMBUSTION ENGINES

[75] Inventors: Heinz Andress, Erdmannhausen; Heinz Mueller, Remseck; Mario Rieger, Freiberg, all of Germany

[73] Assignee: Filterwerk Mann & Hummel GmbH, Ludwigsburg, Germany

[21] Appl. No.: 241,342

[22] Filed: May 11, 1994

[30] Foreign Application Priority Data

May 11, 1993 [DE] Germany ..... 93 07 147.7 U

[51] Int. Cl.[6] ..... F02B 77/00

[52] U.S. Cl. ..... 123/198 E; 55/313; 55/385.3; 55/DIG. 28

[58] Field of Search ..... 123/198 E; 55/385.3, 55/DIG. 28, 313

[56] References Cited

U.S. PATENT DOCUMENTS 1,853,496 4/1932 Blair .

3,077,715 2/1963 Carroll ..... 55/313

3,203,158 8/1965 Zadra .

4,273,564 6/1981 Sugie et al. .

FOREIGN PATENT DOCUMENTS 239350 10/1988 Japan ..... 123/198 E

*Primary Examiner*—Noah P. Kamen

*Attorney, Agent, or Firm*—Evenson, McKeown, Edwards & Lenahan

[57] ABSTRACT

An air filter for an internal combustion engine which has a filter insert is arranged in a housing having a clean air outlet and an unfiltered air inlet provided with a screen. An auxiliary unfiltered air inlet is also provided which is closed by a flap under normal operating conditions but which opens under the influence of a negative pressure generated in the filter housing if the screen becomes clogged because of snow or ice entrained in the air stream, so that air can enter the filter through the auxiliary air inlet.

11 Claims, 4 Drawing Sheets

AIR FILTER FOR INTERNAL COMBUSTION ENGINES

BACKGROUND OF THE INVENTION

This invention relates to an air filter for internal combustion engines comprising a housing with a clean air outlet and an unfiltered air inlet provided with a screen, and a filter insert in the housing.

Air filters for internal combustion engines of motor vehicles usually have an inlet for unfiltered air arranged in an area to which cold air can flow unhindered. The air inlet is therefore normally situated behind the radiator grill of the vehicle or in the vicinity of a fender. It has been found, particularly in countries where snow is abundant, that during drives which are confronted by heavy snowfall or blowing snow, snow is aspirated together with the unfiltered air into the air filter, and this entrained snow accumulates on the filter insert and may clog the filter. Such clogging may even become sufficiently severe to stop the engine.

Another disadvantage of entrained snow is that when the engine is turned off, the snow accumulated on the air filter insert may start to melt and then refreeze to form a layer of ice which interrupts the air supply to the engine and therefore prevents the engine from starting.

SUMMARY OF THE INVENTION

It is therefore the object of the invention to provide an improved air filter arrangement which prevents entrained snow from clogging the filter.

Another object of the invention is to provide an air filter arrangement which enables an internal combustion engine to operate under conditions of heavy snowfall or blowing snow.

These and other objects of the invention are achieved by providing an air filter for an internal combustion engine comprising a housing having an unfiltered air inlet provided with a screen and a clean air outlet, and a filter insert arranged in the housing, wherein said housing has an auxiliary air inlet covered by a normally closed flap, and the flap opens under the influence of a negative pressure produced in the filter housing to allow unfiltered air to enter the housing through said auxiliary air inlet.

A significant advantage of the invention is the combination of a screen with an auxiliary unfiltered air inlet which opens up when a predetermined negative pressure arises in the air filter housing due to clogging of the screen by snow. The auxiliary unfiltered air inlet is arranged such that it takes in snow-free air. Normally, this snow-free air is obtained in the vicinity of the exhaust manifold of the engine or behind the radiator casing or at a corresponding location. If preheated intake air is supplied through this auxiliary unfiltered air inlet, then there is a possibility that the snow retained by the screen will melt, so that the primary unfiltered air inlet can resume its normal function.

According to another advantageous embodiment of the invention, if a spring-loaded flap is used, the spring is a loop spring which has projecting legs at its ends. One of the legs is supported against the stationary housing, and the other leg effectively exerts a force on the center of the flap through a web or stay formed on the flap. This type of a spring has the advantage that it is very easy to assemble. Such a spring needs only to be snapped into its holder, and suspension or additional attachment is not necessary.

In accordance with a further embodiment of the invention, the flap is attached in a simple manner. The flap is provided with a shaft which is pushed at one end into a so-called offset bearing and the opposite end is lockingly received in an open bearing. In this case also, no additional fastening elements are required. The entire flap system can be integrated in the unfiltered air inlet or may comprise a part of the unfiltered air inlet. Again in this case, when suitable locking detents or snap connections are used, no additional attachment members are required.

In accordance with a further embodiment of the invention, the screen is provided with a plastic ring and fastened in place by resiliently locking it in the unfiltered air inlet.

The flap which closes off the auxiliary unfiltered air inlet may be spring-loaded or weight-loaded. The important thing is to adapt the size of the weight or the force of the spring to a maximal negative pressure in the air filter housing below which the pressure should not fall.

It has been found to be advantageous to use a screen which has a mesh size of approximately 0.2 mm. This mesh size is suitable for effectively retaining even the finest snow particles or snow crystals.

These and other features of preferred embodiments of the invention will be apparent from the description in the specification and/or the illustrations in the drawings, as well as the recitations of the claims. The individual features may be implemented separately or combined in subcombinations in the embodiments of the invention, which also may be utilized in other fields of use, and which may represent advantageous, separately protectable constructions, for which protection is also claimed.

BRIEF DESCRIPTION OF THE DRAWINGS

The invention will be described in further detail with reference to illustrative preferred embodiments shown in the accompanying drawings in which.

DETAILED DESCRIPTION OF PREFERRED EMBODIMENTS

Figure 1:
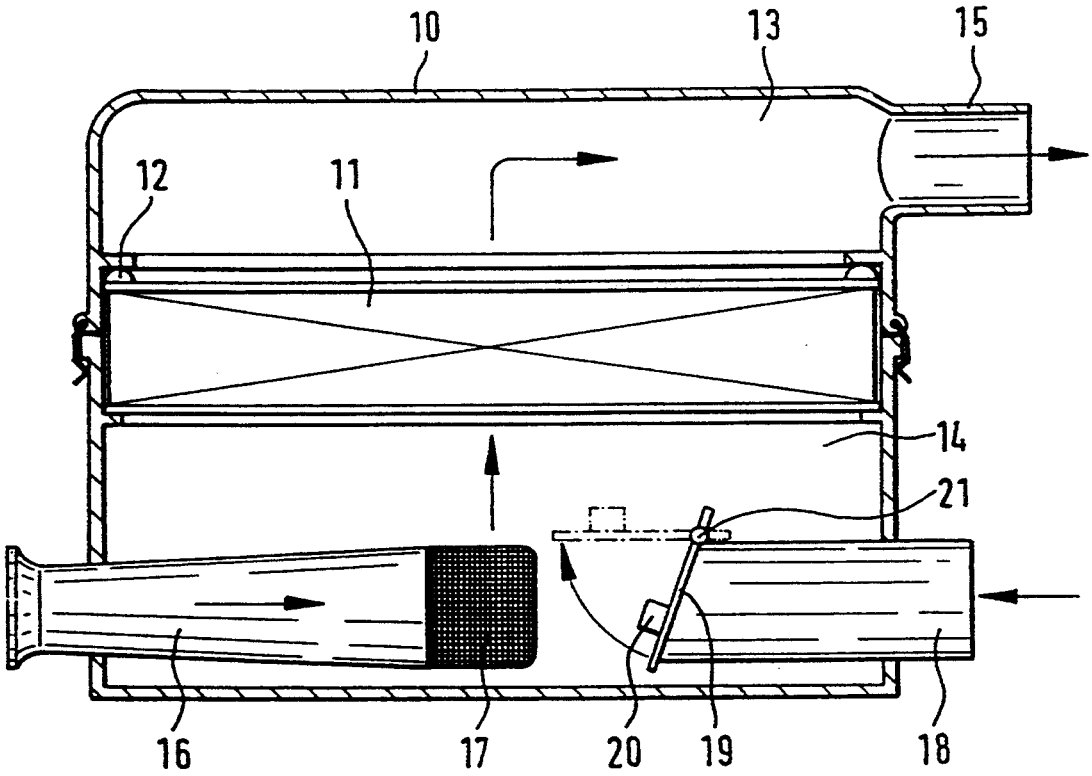
FIG. 1 is a sectional view of an air filter with a dual intake system.

FIG. 1 shows an air filter insert 11 arranged inside an air filter housing 10. Filter insert 11 may consist, for example, of an accordion-folded filter paper which is provided with a surrounding seal member 12 and is arranged with the seal in a receptacle in filter housing 10.

Filter insert 11 separates a clean air chamber 13 from an unfiltered air chamber 14. The clean air chamber 13 is provided with a connecting sleeve 15. Filtered clean air flows through this connecting sleeve 15 to an internal combustion engine (not shown). A first inlet tube 16 is disposed in the unfiltered air chamber 14, through which combustion air (cold air) is supplied to the filter device.

The open end of inlet tube 16 proximate the unfiltered air chamber is provided with a screen 17, illustrated here in the form of a basket. Screen 17 is lockingly mounted in said unfiltered air inlet tube 16. Screen 17 comprises a screen with a mesh size of from 0.2 mm to 0.3 mm and is used to effectively retain snow and ice crystals entrained in the air stream. If the screen encounters a large amount of snow, it will inevitably clog. This prevents further air from being drawn into the filter through inlet tube 16.

For this reason, an auxiliary intake conduit 18 is provided. The inlet of this intake conduit is disposed at a location within the vehicle engine compartment which is free of snow. This may, for example, lie in the vicinity of the exhaust manifold or directly behind the radiator casing or at any other snow-free point. If the inlet is disposed behind the radiator casing, care should be taken that the inlet surface extends at a right angle to the radiator surface. The inner opening of auxiliary intake conduit 18 proximate the unfiltered air chamber is closed off by a flap 19. Flap 19 may be spring-loaded or weight-loaded or be closed by a suitable electronic control system. In the illustrated embodiment shown in FIG. 1, flap 19 is pivotally mounted by a hinge 21 and is provided with a weight 20. If a spring-loaded flap is used, the spring may be situated in the hinge 21. As soon as screen 17 is clogged by snow or snow crystals, a negative pressure arises in the filtered air chamber of the filter due to the intake of combustion air by the internal combustion engine. This negative pressure is transmitted through the filter to the unfiltered air chamber 14. This negative pressure causes flap 19 to open so that combustion air can now flow in through the auxiliary intake conduit 18. If the combustion air drawn in through auxiliary intake conduit 18 is slightly heated, this may cause the snow collected on screen 17 to melt, thereby reopening intake tube 16 so that fresh air can subsequently be drawn in again through the primary air inlet. Consequently, the negative pressure in the unfiltered air chamber will fall, and flap 19 will close again. The weight 20, or the spring force in the case of a spring-loaded flap, is selected to be such that the negative pressure which is required to open the flap does not exceed a predetermined permissible value.

Figure 2:
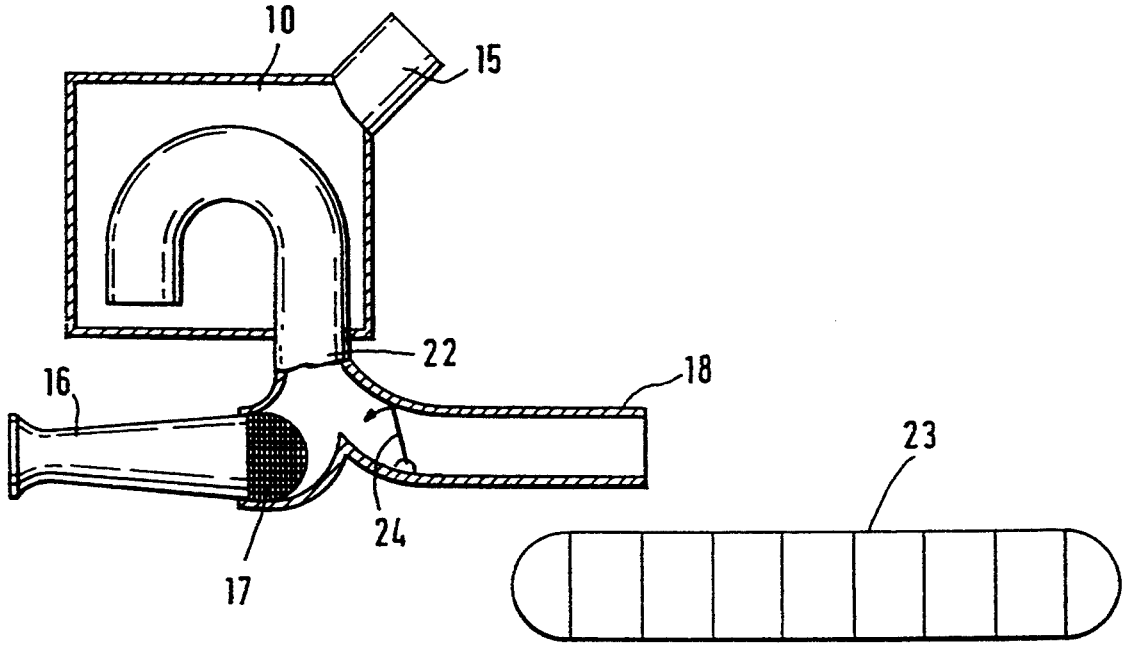
FIG. 2 is a view of a variant embodiment of the intake system of the invention.

FIG. 2 is a top view of the air filter housing 10 of an alternate air filter intake system in accordance with the invention. Air filter housing 10 is provided with a connecting sleeve 15 for discharging clean air and with a connecting conduit 22 for unfiltered air. The unfiltered air inlet 22 branches and leads to an air inlet 16 which is provided with a screen 17.

Furthermore, an air inlet 18 is also provided. This air inlet 18 is arranged directly behind a vehicle radiator 23. Normally, the air inlet 18 is closed off by means of a spring-loaded flap 24. If snow crystals or ice crystals clog the screen 17, flap 24 will open due to the negative pressure which will arise in filter housing 10, so that warm air will be drawn in through unfiltered air inlet 18.

Figure 3:
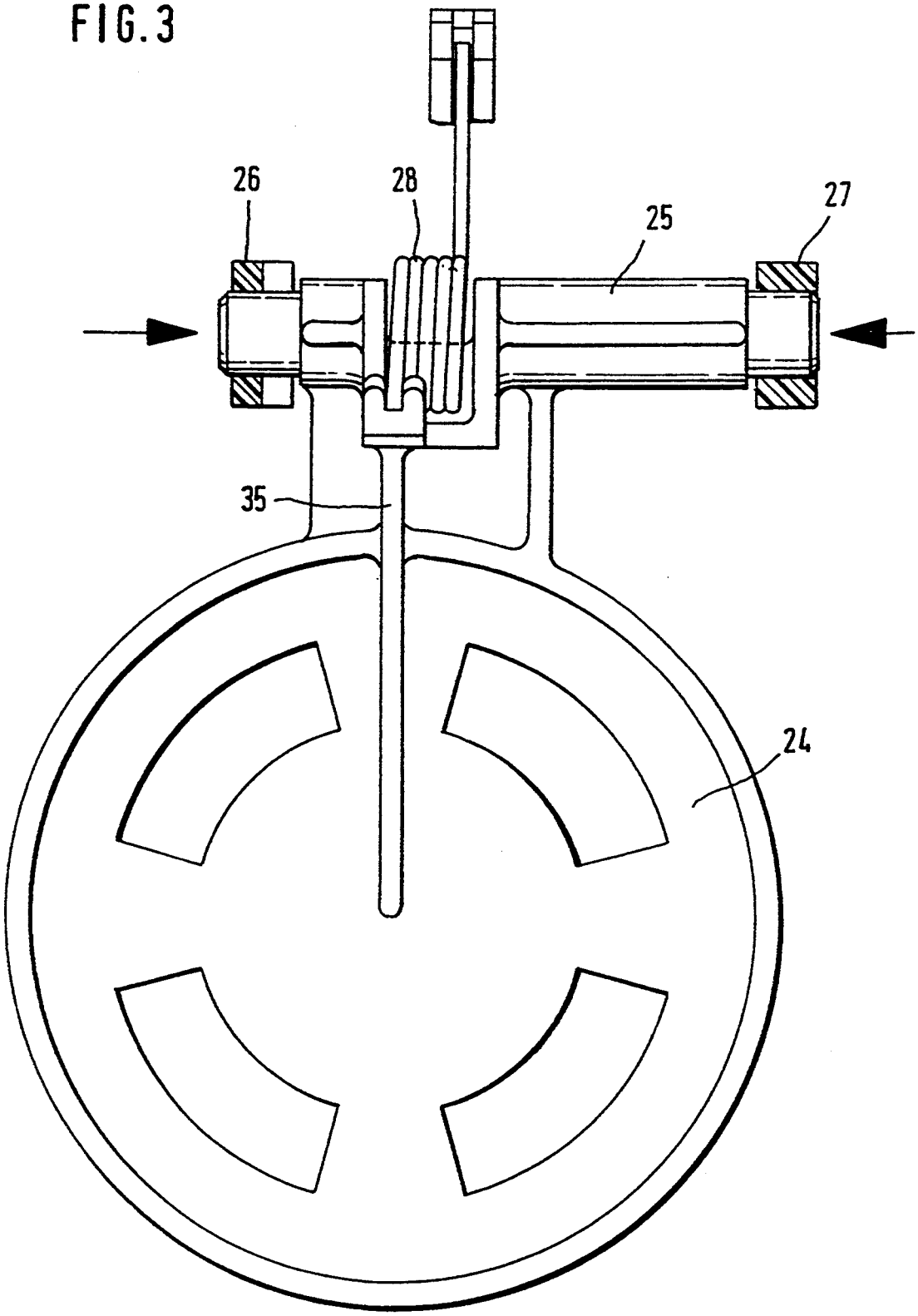
FIG. 3 is a detailed view of a spring-loaded flap according to the invention.

The detailed view according to FIG. 3 illustrates a flap 24 which closes an intake conduit (not shown). Flap 24 is attached by a shaft 25 to a filter housing. On the left side of the drawing, the shaft 25 is received in a so-called offset bearing 26, and on the right side of the drawing the shaft 25 is snapped from above into an open bearing 27. The offset bearing 26, whose lower half-shell is constructed in a right-sided manner and whose upper half-shell is constructed in a left-sided manner, has the advantage that it is possible to insert the shaft outside the axial alignment. Flap 24 comprises an injection molded plastic part and is provided with a centrally arranged rib 35.

Figure 4:
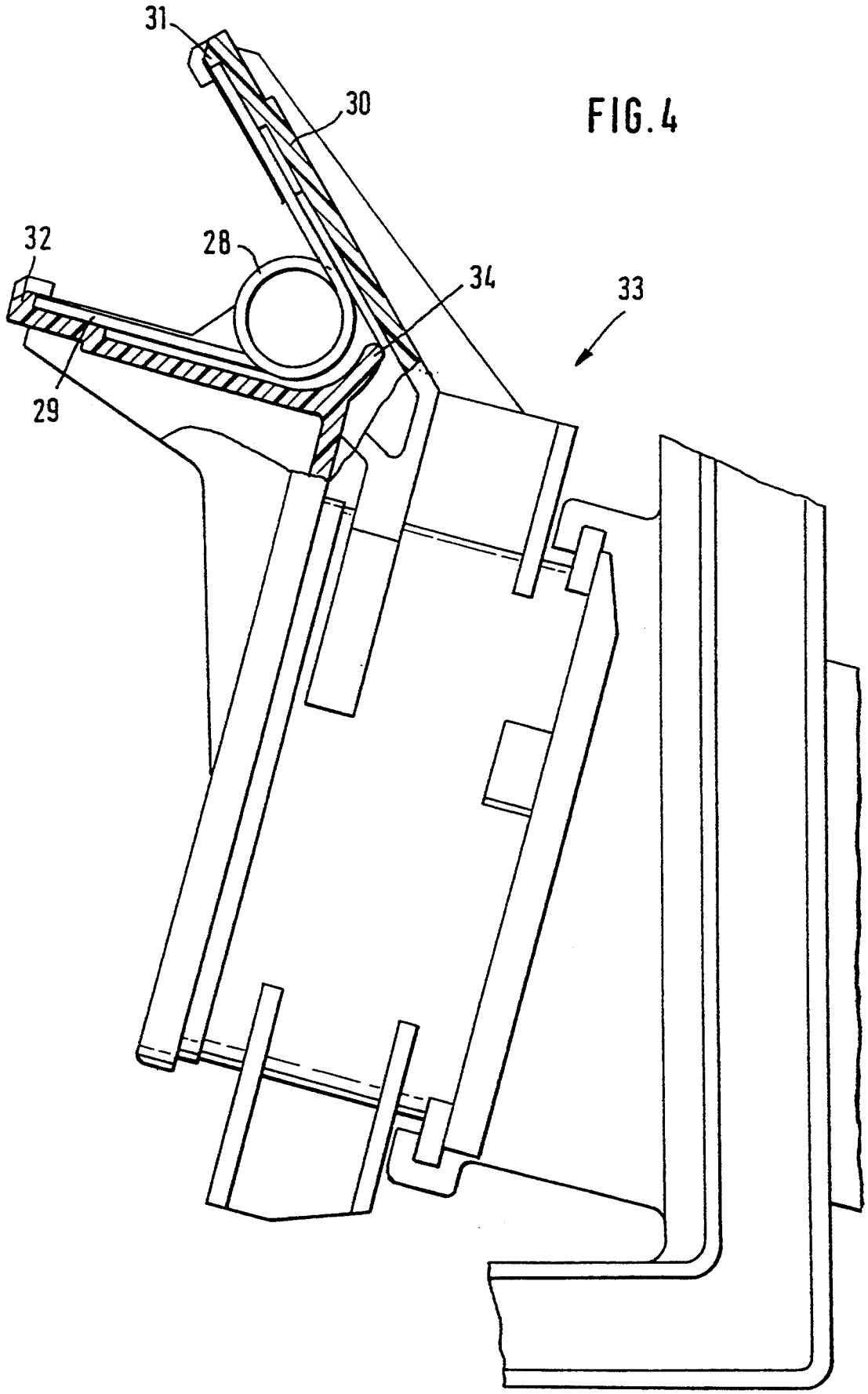
FIG. 4 is a side view of the spring-loaded flap of FIG. 3.

As shown in FIG. 4, the leg 29 of the spring 28 rests against the rib 35 and exerts a closing force. The other leg of the spring 28 is supported on a holding part 30 fixed to the housing. During the mounting, the spring is inserted between the two bearing legs and is held in its installed position by projecting noses 31 and 32. The entire flap assembly 33 constitutes a modular unit which can be attached as an assembled system and can be fitted to an unfiltered air inlet (not shown) or integrated with said housing adjacent said unfiltered air inlet as in the embodiment illustrated in FIG. 1. As shown in FIG. 3, the spring is arranged in the vicinity of the offset bearing 26. Thus a larger lever arm to the bearing 27 is achieved so that, because of the effect of the spring, low transverse forces are exercised on the bearing 27. The receiving point for the spring inside the shaft 25 is designed in the shape of an open U. This U may be reinforced by means of ribs or, as indicated in FIG. 4, be closed off by means of a pocket bottom 34. This ensures the stability of the shaft 25 and defines the installation space of the spring.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An air filter for an internal combustion engine comprising a housing having an unfiltered air inlet provided with a screen and a clean air outlet, a filter insert arranged in the housing, wherein said housing has an auxiliary air inlet covered by a normally closed flap, and said flap opens only under the influence of a negative pressure produced in the filter housing to allow unfiltered air to enter the housing through said auxiliary air inlet.

2. An air filter according to claim 1, wherein said flap is a weight-loaded flap.

3. An air filter according to claim 1, wherein said flap 19 is a spring-loaded flap.

4. An air filter according to claim 3, wherein the force exerted by the spring acts upon the flap through a stiffening rib arranged at the center of the flap.

5. An air filter according to claim 1, wherein said unfiltered air inlet screen has a mesh size of from 0.2 to 0.5 mm.

6. An air filter according to claim 1, wherein said flap is spring-loaded toward its closed position by a spring which comprises at least one turn and which has tangentially directed legs on both ends, said spring legs being compressed between an abutment fixed on said housing and a web at the center of said flap.

7. An air filter according to claim 6 wherein said flap is mounted on a shaft having ends received in a pair of bearings, and at least one of said bearings is an open bearing, whereby said shaft can be introduced tangentially or radially with respect to said shaft.

8. An air filter according to claim 6, wherein said flap is mounted on a shaft having ends received in a pair of bearings, and at least one of said bearings is an offset bearing which permits the flap shaft to be inserted when inclined in the axial direction.

9. An air filter according to claim 1, wherein said flap is constructed as a modular unit together with a bearing about which the flap pivots and with means for biasing the flap toward the closed position; and said modular unit is attached to said unfiltered air inlet.

10. An air filter according to claim 1, wherein said screen is lockingly mounted in said unfiltered air inlet.

11. An air filter according to claim 1, wherein said flap is constructed as a modular unit together with a bearing about which the flap pivots and with means for biasing the flap toward the closed position; and said modular unit is integrated with said housing adjacent said unfiltered air inlet.

* * * * *